United States Patent [19]

Trout et al.

[11] Patent Number: 4,783,389

[45] Date of Patent: Nov. 8, 1988

[54] PROCESS FOR PREPARATION OF LIQUID ELECTROSTATIC DEVELOPERS

[75] Inventors: Torence J. Trout; James R. Larson, both of Wilmington, Del.

[73] Assignee: E. I. Du Pont de Nemours and Company, Wilmington, Del.

[21] Appl. No.: 30,993

[22] Filed: Mar. 27, 1987

[51] Int. Cl.[4] ..... G03G 9/12

[52] U.S. Cl. ..... 430/137; 430/114

[58] Field of Search ..... 430/109, 137, 114; 428/407; 252/62.1

[56] References Cited

U.S. PATENT DOCUMENTS

| | | | |
|---|---|---|---|
| 3,514,043 | 5/1970 | Slepetys | 241/5 |
| 3,944,493 | 3/1976 | Jadwin et al. | 430/109 |
| 4,345,013 | 8/1982 | Diamond et al. | 430/109 |
| 4,533,254 | 5/1985 | Cook et al. | 366/176 |
| 4,599,294 | 7/1986 | Matsumoto et al. | 430/137 |

FOREIGN PATENT DOCUMENTS 2169416A 7/1986 United Kingdom .

*Primary Examiner*—John L. Goodrow

[57] ABSTRACT

Process for the preparation of toner particles for liquid electrostatic imaging comprising (A) mixing a thermoplastic resin and a nonpolar liquid at a temperature sufficient to plasticize and liquify the resin and below that at which the nonpolar liquid boils and the resin decomposes, (B) cooling the mixture to form resin particles in the nonpolar liquid, (C) reducing the size of the resin particles to below about 30 μm by passing the product of step (B) through at least one liquid jet interaction chamber at a liquid pressure of at least 1000 p.s.i., e.g., a Microfluidizer ®.

The process produces liquid electrostatic developer quicker than other known processes, the developer being useful in copying, making proofs, including digital proofs, etc.

36 Claims, No Drawings

PROCESS FOR PREPARATION OF LIQUID ELECTROSTATIC DEVELOPERS

TECHNICAL FIELD

This invention relates to an improved process for the preparation of liquid electrostatic developers. More particularly this invention relates to a process for the preparation of toner particles composed of solid resin for liquid electrostatic imaging in a short time period.

BACKGROUND OF THE INVENTION

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters a low dielectric constant below 3.0 and a high vapor pressure. The toner particles are less than 10 μm average by area size as measured hy a Horiba CAPA-500 centrifugal automatic particle analyzer. After the latent electrostatic image has been formed, the image is developed by the colored toner particles dispersed in said nonpolar liquid and the image may subsequently be transferred to a carrier sheet.

Many methods for making liquid electrostatic developers are known. For example, as described in Landa et al. U.K. patent application No. 2169416A published July 9, 1986, electrostatic toners are prepared by plasticizing a thermoplastic polymer and pigment with a nonpolar liquid to form a gel or solid mass and shredding the mass into pieces. After the addition of more nonpolar liquid, the pieces are ground into toner particles.

Another process for the preparation of liquid electrostatic developer is described in Larson U.S. Ser. No. 804,385 filed Dec. 4 1985. This process comprises (a) dispersing in a nonpolar liquid a thermoplastic resin and optionally a colorant using moving particulate media, the temperature being sufficient to plasticize and liquefy the resin and below the decomposition temperature of the resin and/or colorant and below the nonpolar liquid boiling point; (b) cooling the dispersion while maintaining continuous movement of the particulate media during and subsequent to cooling whereby electrostatic toners particles are formed.

These and other processes for preparation of liquid electrostatic developers are disadvantageous because they require relatively long preparation time primarily due to long cold grinding cycles for particle size reduction.

It is therefore desirable that liquid electrostatic developers having properties equal or better than those prepared by previous methods be prepared by a new method in a shortened time period.

DISCLOSURE OF THE INVENTION

In accordance with this invention there is provided a process for the preparation of toner particles for liquid electrostatic imaging comprising A. mixing a thermoplastic resin and a nonpolar liquid at a temperature sufficient to plasticize and liquify the resin and below that at which the nonpolar liquid boils and the resin decomposes, B. cooling the mixture to form particles of the resin in the nonpolar liquid, C. reducing the size of the resin particles to below about 30 μm by passing the mixture of resin particles and nonpolar liquid through at least one liquid jet interaction chamber at a liquid pressure of at least 1000 p.s.i. ($6.89\times10^6$ kg/m.sec.$^2$).

An apparatus having a liquid jet interaction chamber useful in step C of the process of the invention is a Microfluidizer® manufactured by Microfluidics, Newton, Mass. Apparatus of this type are described in Cook et al. U.S. Pat. No. 4,533,254 which is incorporated herein by reference. Various embodiments of the liquid jet interaction chamber are disclosed therein in columns 3 and 4 and FIGS. 2 to 9, column 6, line 55 to column 8 line 32: FIGS. 10 to 13, column 8, line 33 to column 9. line 42; and FIGS. 14 to 20, column 9, line 43 to column 10, line 43; with further improvements in the embodiment illustrated in FIGS. 14 to 20 being shown in FIGS. 22 to 24, column 10, line 59 to column 11, line 20; incorporated herein by reference. This apparatus has been used in the preparation of fine emulsions, microemulsion, dispersions, etc. by the dynamic interaction of two fluid streams in precisely defined geometry, e.g., microchannels. A fine emulsion having a narrow size distribution is defined as one in which the droplet size of the dispersed phase is substantially below 1 μm. The inventors are not aware of the use of a liquid jet interaction chamber in the preparation of electrostatic liquid developers wherein solid resin particles are reduced in size.

The liquid jet interaction chamber block of the apparatus comprises (a) a plurality of submerged nozzles providing elongated orifices arranged to eject under pressure a plurality of thin sheets of the mixture of thermoplastic resin and nonpolar liquid, the nozzles being arranged to effect turbulent jet action of the sheets along a common liquid jet interaction front and the sheets being ejected by the nozzles into a low pressure zone filled with the liquid further creating turbulent jet interaction along a common boundary essentially defined and formed by the mixture in the low pressure zone and by the sheets ejected into the low pressure zone;

(b) jet interaction chamber-defining means arranged to provide the low pressure zone of the liquid system in which the turbulent jet interaction is effected;

(c) inlet channel means to deliver the mixture under pressure to the nozzles; and (d) means to withdraw the mixture of resin particles and nonpolar liquid in the form of a dispersion from the low pressure zone.

The above described apparatus, which is operated at a pressure of at least 1000 p.s.i. ($6.89\times10^6$ kg/m.sec.$^2$), e.g., 1000 p.s i. ($6.89\times10^6$ kg/m.sec.$^2$) to 20,000 p.s.i. ($13.78\times10^7$ kg/m.sec$^2$), not only can be used for step C of the process hut heat mixing step A as well. Step A of the invention is not limited to the use of the apparatus having a liquid jet interaction chamber but other devices for heating the components and mixing, e.g., by stirring preferably with high shear, can be used in this step, e.g., in a mixing. grinding or blending vessel such as a vessel equipped with a stirrer; attritor, heating ball mill, heated vibratory mill such as a Sweco Mill manufactured by Sweco Co., Los Angeles, Calif., equipped with particulate media; Ross double planetary mixer manufactured by Charles Ross and Son, Hauppauge, N.Y. equipped with a stirrer (no particulate media necessary), twin-screw extruder, etc.

The thermoplastic resin and nonpolar liquid are fed through or placed in a vessel or apparatus and mixed by stirring or preferably under shear conditions at a temperature sufficient to plasticize and liquify the resin. Care must be taken to insure that the temperature is below that at which the nonpolar liquid boils and the resin decomposes. Generally a temperature in the range of 80° to 120° C. is satisfactory although other temperatures outside this range may be suitable depending on the particular ingredients used. Optionally the colorant can be present in the vessel or apparatus. Preferably the colorant is added after homogenizing the resin and nonpolar liquid. Polar additive can also be present in the vessel or apparatus, e.g., up to 100% by weight based on the weight of polar additive and nonpolar liquid.

Preferably step A is accomplished in an attritor apparatus which when in operation has irregularly moving particulate media in the vessel. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0 5 inch (1.0 to approx. 13 mm).

After mixing the ingredients in the vessel or apparatus, with or without a polar additive present until the desired degree of mixing is achieved, typically 15 minutes to 2 hours depending on the particular apparatus used with the mixture being fluid, the mixture is cooled to form particles of the resin, e.g., in the range of 0° C. to 50° C. Cooling may be accomplished. for example, in the same or different vessel or apparatus. Additional liquid may be present. Additional liquid means dispersant nonpolar liquid, polar liquid or combinations thereof. Cooling is accomplished by means known to those skilled in the art and is not limited to ccoling by circulating cold water or a cooling material through an external cooling jacket adjacent the dispersing apparatus or permitting the dispersion to cool to ambient temperature. The resin precipitates out of the mixture or solidifies during the cooling. Before or after cooling the particulate media, if present, are removed by means known to those skilled in the art.

Subsequently the size of the resin particles are reduced. For example, in one embodiment of the process the mixing of step A and the reduction of the size of the resin particles is accomplished in an apparatus having at least one liquid jet interaction chamber of the type described above. In a second embodiment of the process the mixing step A is accomplished in an attritor or a double planetary jacketed mixer and step C as required, is accomplished in the apparatus having at least one liquid jet interaction chamber. It has been found that the reduction in size of the resin particles can be accomplished in a relatively short period of time, much quicker than in known processes for making liquld electrostatic developers. Known apparatus having at least one liquid jet interaction chamber, e.g., preferably two in series, have a capacity up to 50 gallons (190 liters)-/minute. The average time to make liquid electrostatic developer varies depending on the size of the apparatus available which produce per pass through the apparatus at the rate of 0.1 gallon (0.38 liter)/minute up to 50 gallons (190 liters)/minute and ranges in between. Of course, longer reduction periods by repeated passes through the apparatus can be used but generally are not necessary.

After the reduction in size of the resin particles in step C the toner particles have an average particle size of less than about 30 μm, preferably less than about 15 μm as measured using a Malvern 3600E Particle sizer described more fully below. Various instruments are known to measure the particle size. One such instrument is a Horiba CAPA-500 centrifugal particle analyzer, manufactured by Horiba Instruments, Inc., Irvine, Calif. In determining particle size by area. a solvent viscosity of 1.24 cps, solvent density of 0.76 g/cc, sample density of 1.32 using a centrifugal rotation of 1.000 rpm, a particle size by area range of 0.01 to less than 10 μm, and a particle size by area cut of 1.0 μm are used. Another instrument for measuring average average particle sizes is a Malvern 3600E Particle Sizer manufactured by Malvern, Southborough, Mass. which uses laser diffraction light scattering of stirred samples to determine average particle sizes. Since these instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Malvern instrument.

Before or after the resin particles have been reduced in size as described, it is possible to reduce the concentration of the toner particles in the developer, impart an electrostatic charge of predetermined polarity to the toner particles, or a combination of these variations. It is preferable to perform the particle size reduction at a relatively high percentage by weight solids based on the total weight of liquid developer, e g., 2 to 25% by weight solids, preferably 5 to 20% by weight solids based on the total weight of liquid developer. The concentration of the toner particles in the developer is reduced by the addition of additional nonpolar liquid as described previously above. The dilution is normally conducted to reduce the concentration of toner particles to between 0.1 to 10 percent by weight, preferably 0.3 to 3.0, and more preferably 0.5 to 2 weight percent with respect to the nonpolar liquid. One or more nonpolar liquid soluble ionic or zwitterionic charge director compounds, of the type described below, can be added to impart a charge, as desired. The addition may occur at any time during the process; preferably at the end of the process, e.g., after formation of toner particles and dilution of toner particles is accomplished. If a diluting nonpolar liquid is also added, the ionic or zwitterionic compound can be added prior to, concurrently with, or subsequent thereto. If an adjuvant compound of a type described below has not been previously added in the preparation of the developer it can be added prior to or subsequent to the developer being charged. Preferably the adjuvant compound is added after reducing the size of the resin particles.

Ingredients useful in the process of this invention include the following materials: Nonpolar liquids which are, preferably branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C. Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method. of 40° C., Isopar®-H has a flash point of 53° C. determined by ASTM D 56. Isopar®-L and Isopar®-M have flash points of 61° C. and 80° C., respectively, determined by the same method. While these are the preferred nonpolar liquids, the essential characteristics of all suitable nonpolar liquids are the electrical volume resistivity and the dielectric constant. In addition a feature of the nonpolar liquids is a low Kauri-butanol value less than 30. preferably in the vicinity of 27 or 28, determined by ASTM D 1133. The ratio of thermoplastic resin to nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the ingredients described more fully below such as the resin, including components dispersed therein, e.g., pigment component, adjuvant, etc.

Useful thermoplastic resins or polymers include: ethylene vinyl acetate (EVA) copolymers (Elvax® resins, E. I. du Pont de Nemours and Company, Wilmington. Del.), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins. e.g., DQDA 6479 Natural and DQDA 6832 Natural 7 also sold by Union Carbide Corp.; Surlyn® ionomer resin by E. I. du Pont de Nemours and Company, Wilmington, Del., etc., or blends thereof. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is mlligrams potassium hydroxide required to neutralize 1 gram of polymer. The melt index (g/10 min) of 10 to 500 is determined by ASTM D 1238, procedure A. Particularly preferred copolymers of this type have an acid number of 66 and 60 and a melt index of 100 and 500 determined at 190° C., respectively.

The thermoplastic resins described above can have dispersed therein a colorant and optionally a metallic soap.

In addition, the resins have the following preferred characteristics:

1. Be able to disperse the inorganic salt, metallic soap, colorant, e.g. pigment, etc.

2. Be insoluble in the dispersant liquid at temperatures below 40° C., so that the thermoplastic resin will not dissolve or solvate in storage, 3. Be able to solvate at temperatures above 50° C.

4. Be able to form particles between 0.1 μm and 5 μm, in diameter (preferred size), e.g. determined by Horiba CAPA-500 centrifugal particle analyzer; and between about 1 μm and 15 μm, in diameter, e.g., determined by Malvern 3600E Particle Sizer as described above.

5. Be able to form a particle (average by area) of less than 10 μm, e.g., determined by Horiba CAPA-500 centrifugal automatic particle analyzer, and, about 30 μm average particle size e.g., determined by Malvern 3600E Particle Sizer as described above.

6. Be able to fuse at temperatures in excess of 70° C. By solvation in 3. above, the resins forming the toner particles will become swollen or gelatinous.

Suitable nonpolar liquid soluble ionic or zwitterionic charge director compounds, which are generally used in an amount of 0.25 to 1500 mg/g, preferably 2.5 to 400 mg/g developer solids include: negative charge directors e g., lecithin, Basic Calcium Petronate®, Basic Barium Petronate® oil-soluble petroleum sulfonate, Neutral Barium Petronate®, manufactured by Sonneborn Division of Witco Chemical Corp. New York, N.Y., etc.; positive charge directors. e.g., sodium dioctylsulfosuccinate (manufactured by American Cyanimid Co.), zirconium octoate, and metal soaps such as copper oleate, cobalt, iron and manganese naphthenate, zinc and aluminum stearate, zinc resinate, etc.

As indicated above, colorants are dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3). Quindo® Magenta (Pigment Red 122), Indo® Brilliant Scarlet (Pigment Red 123, C.I. No. 71145). Toluidine Red B (C.I. Pigment Red 3). Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1). Monastral® Blue B (C.I. Pigment Blue 15). Monastral® Green B (C.I. Pigment Green 7), Pigment Scarlet (C.I. Pigment Red 60), Auric Brown (C.I. Pigment Brown 6). Monastral® Green G (Pigment Green 7), Carbon Black. Cabot Mogul L (black pigment C.I. No. 77266) and Sterling NS N 774 (Pigment Black 7, C.I. No. 77266).

Other ingredients may be added to the liquid electrostatic developer, such as fine particle size oxides, e.g, silica, alumina, titania, etc.; Preferably in the order of 0.5 μm or less can be dispersed into the liquefied resin. These oxides can be used in combination with the colorant. Metal particles can also be added as can magnetic particles.

Another additional component of the liquid electrostatic developer is an adjuvant which can be taken from the group of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc.

aminoalcohol compounds: triisopropanolamine, triethanolamine, ethanolamine, 3-amino-1-propanol. o-aminophenol, 5-amino-1-pentanol, tetra(2-hydroxyethyl)ethylenediamine, etc.

polybutylene succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

metallic soap: aluminum tristearate; aluminum distearate; barium, calcium, lead and zinc stearates: cobalt, manganese, lead and zinc linoleates; aluminum, calcium, and cobalt octoates: calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout, U.S. application Ser. No. 857,326, filed Apr. 30, 1986 now U.S. Pat. No. 4,707,429, the disclosure of which is incorporated herein by reference.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc.

The resin particles of the developer may or may not be formed having a plurality of fibers integrally extending therefrom. The term "fibers" as used herein means toner particles formed with fibers, tendrils, tentacles, threadlets, fibrils, ligaments, hairs, bristles, or the like. A preferred mode of the invention is described in Example 8.

INDUSTRIAL APPLICABILITY

The process of this invention produces a liquid electrostatic developer. The developer contains toner particles having a controlled particle size range which can be prepared more quickly than by previously known processes for making liquid electrostatic toners. The developer is of the liquid type and is particularly useful in copying, e.g., making office copies of various color as well as of black and white. Color proofs, e.g., a reproduction of an image using the standard colors can also be made using several developers: yellow, cyan and magenta together with black as desired. In copying and proofing the liquid electrostatic developer is applied to a latent electrostatic image.

Other uses are envisioned for the liquid electrostatic developers, e.g., the formation of copies or images using toner particles containing finely divided ferromagnetic materials or metal powders; conductive lines using developers containing conductive materials, resistors, capacitors and other electronic components: lithographic printing plates, etc.

EXAMPLES

The following examples wherein the parts and percentages are by weight illustrate but do not limit the invention. In the examples lp/mm means line pairs/mm, the melt indices were determined by ASTM D 1238, Procedure A, the average particle sizes were determined by a Malvern 3600 particle Sizer (Malvern, Southborough, Mass.) or a Horiba CAPA-500 centrifugal particle analyzer (by area) as described above, the density was measured using a Macbeth densitometer model RD918, transfer efficiency is determined as follows: a toned electrostatic image is transferred from the photoreceptor in the copier to a paper carrier sheet. A transparent adhesive tape is applied over the residual toned electrostatic image on the photoreceptor and the residual image is removed with the tape and placed on the previously image carrier sheet adjacent to (but not contacting) the transferred image. The density of both images is measured with a densitometer as previously described. The transfer efficiency is the percentage value obtained by dividing the density of the transferred image by the sum of the densities of the transferred and residual images.

The apparatus having a liquid jet interaction chamber used in the examples below is a Microfluidizer ® Model M-110 (Microfluidics, Newton, Mass.) equipped with a standard interaction chamber and back pressure module (H10-H30) and a backflush system. The Microfluidizer ® had a flow rate of about 0.1 gallon (0.38 liter)/minute and the output of the apparatus was equipped with a tap water cooled heat exchanger which cools the output.

CONTROL 1

A yellow toner was prepared using the following procedure: In a Union Process 01 Attritor ®, Union Process Company, Akron, Ohio, was placed the following ingredients:

| Ingredients | Amount (g) |
|---|---|
| Copolymer of ethylene (89%) and methacrylic acid (11%), melt index at 190° C. is 100, acid number is 66 | 35.0 |
| Dalamar ® Yellow YT-858D pigment, manufactured by Heubach, Inc., Newark, NJ | 0.69 |
| Aluminum Tristearate #132, Witco Chemical Corporation, New York, NY | 0.73 |
| Isopar ®-L nonpolar liquid having a Kauri butanol value of 27, Exxon Corporation | 125.0 |

The ingredienst were heated to 90° C. to 110° C. and milled at a rotor speed of 230 rpm with 0.1875 inch (4.76 mm) diameter carbon steel balls for 2 hours. The Attritor ® was cooled to 42° C. 50° C. while milling was continued and then 125 grams of Isopar ®-H nonpolar liquid having a Kauri butanol value of 27, Exxon Corporation were added. Milling was continued for 9 hours and the average particle size was monitored. The particulate meida were removed and the dispersion of toner particles was then diluted to 2% solids with additional Isopar ®-H and a charge director such as Basic Barium Petronate ® was added (150 mg Basic Barium Petronate ®/g of toner solids). Average particle size was 6.8 μm (Malvern) and was 1.96 μm by area (Heriba). Image quality was determined using a Savin 870 copier in a standard mode: Charging corona set at 6.8 kV and transfer corona set at 8.0 kV using carrier sheets such as Plainwell offset enamel paper number 3 class 60 lb test. Image quality results are found in Table 1 below.

EXAMPLE 1

The following ingredients were heated to 100° C. to 110° C. with stirring in a carbon steel pot for 15 minutes:

| Ingredients | Amount (g) |
|---|---|
| Copolymer of ethylene (89%) and methacrylic acid (11%), melt index at 190° C. is 100, acid number is 66 | 100.0 |
| Dalamar ® Yellow YT-858D pigment, manufactured by Heubach, Inc., Newark, NJ | 11.36 |
| Aluminum Tristearate #132, Witco Chemical Corporation, New York, NY | 2.27 |
| Isopar ®-L (see Control 1) | 1022.7 |

The toner melt was run through the heated Microfluidizer ®, which was heated by passing through about 1 liter of Isopar ®-L at 110° C. The Microfluidizer ® was run at 10–12 kpsi ($6.89\times10^7-8.27\times10^7$ kg/m.sec.$^2$) yielding a dispersion time of about 5 minutes. The dispersion passed through the high pressure liquid jet interaction chamber and the backpressure module, and the output was cooled with the tap water cooled beat exchanger. The resulting dispersion was shredded in a blender with an additional 336 grams of Isopar ®-L to produce 7.5% solids. Average particle size measured with a Malvern 3600E Particle Sizer (Malvern, Southborough, Mass.) was 60 to 65 μm.

The Microfluidizer ® was immersed in an ice bath and 1000 g of the dispersion were run with 2 passes to produce toner particles. The dispersion of toner particles was then diluted to 2% solids with additional Isopar ®-L and a charge director such as Basic Barium Petronate ® was added (90 mg Basic Barium Petronate ®/g of toner solids). Average particle size measured with a Malvern 3600E Particle Sizer was 4.5 μm. Image quality was determined using a Savin 870 copier in a standard mode: Charging corona set at 6.8 kV and transfer corona set at 8.0 kV using carrier sheets such as Plainwell offset enamel paper number 3 class 670 lb test. Results are found in Table 1 below.

EXAMPLE 2

In a Ross double planetary jacketed mixer Model LDM, Charles Ross and Son Co., Hauppauge, N.Y., was placed the following ingredients in the amounts indicated:

| Ingredients | Amount (g) |
|---|---|
| Copolymer of ethylene (89%) and methacrylic acid (11%): melt index at 190° C. is 100, acid number is 66 | 500.0 |
| Dalamar ® Yellow YT-858D pigment, manufactured by Heubach, Inc., Newark, NJ | 56.8 |
| Aluminum Tristearate #132, Witco Chemical Corporation, New York, NY | 11.36 |
| Isopar ®-L (see Control 1) | 250.0 |

The ingredients were heated to 90° C.+/−10° C. and stirred at the maximum rate for one hour. The mixture was cooled to 25° C.+/−5° C. with cold water while continuously stirring the ingredients and adding 1250 g of Isopar ®-L. A portion of this dispersion was diluted with Isopar ®-L to give 1 gallon (3.785 liters) of 10% solids for use in the next step. Average particle size measured with a Malvern 3600E Particle Sizer was 42.6 μm.

Further size reduction was done by pumping 2000 g of the above dispersion twice through the Microfluidizer ® immersed in an ice bath, using a pressure of 10–12 kpsi ($6.89\times10^7-8.27\times10^7$ kg/m.sec.$^2$), resulting in a 20 minute particle size reduction time. The dispersion of toner particles was then diluted to 2% solids with additional Isopar®-L and a charge director such as Basic Barium Petronate® was added (92 mg Basic Barium Petronate®/g of toner solids). Average particle size measured with a Malvern 3600E Particle Sizer was 3.1 μm; 0.98 μm (by area) measured with Horiba. Image quality was determined using a Savin 870 copier in a standard mode as described in Example 1 using carrier sheets also as described in Example 1. Image quality was found to be good. Results are found in Table 1 below.

EXAMPLE 3

Toner was prepared and evaluated as described in Example 1 with the following exceptions: 200 g of AC-540 polyethylene resin (Allied Fibers & Plastics Company, Morristown, N.J.). no pigment, no aluminum tristearate and 1800 g Isopar®-L were used. Average particle size measured with a Malvern 3600E Particle Sizer was 3.1 μm; 1.21 μm (by area) measured with Horiba. Results are found in Table 1 below. Density could not be determined because no pigment was present. Percent transfer efficiency was estimated by eye.

EXAMPLE 4

10% Toner was prepared and evaluated as described in Example 1 with the following exception: Aromatic® 150 (Exxon Corporation) was used in place of Isopar®-L during the preparation of the toner. Isopar®-L was used for the 2% dilution. Average particle size was measured with a Malvern 3600E Particle sizer was 7.3 μm. Results are found in Table 1 below.

EXAMPLE 5

100 g polystyrene resin (Polysciences, Inc., Warrington, Pa., Cat. #15790), 18.07 g Dalamar® Yellow YT-858D (Heubach, Inc.), 2.41 g aluminum tristearate and 682.7 g Aromatic® 150 were heated to 100° C., to 110° C. with stirring in a carbon steel pot for 15 minutes. A single pass through the Microfluidizer® was done as in Example 1. The resulting dispersion had an average particle size measured with a Malvern 3600E Particle Sizer of 65.7 μm. The dispersion was air dried for 3 days followed by homogenization in a blender with about 500 g Isopar®-L. This material was dried and blended with about 500 g Isopar®-L two more times. The particles of the resulting dispersion were reduced in size by passing 10 times through the Microfluidizer®. Average particle size as measured on a Malvern instrument analyzer was about 15.3 μm. A sample of this dispersion was diluted with Isopar®-L to give 1805 g a 2% solids. This was charged with 90 mg/g of Basic Barium Petronate® and evaluated as described in Example 1. Results are found in Table 1 below.

EXAMPLE 6

Toner was prepared as described in Example 1 with the following exceptions: 200 g resin, 22.73 g Dalamar® Yellow YT-858D (Heubach, Inc.), 4.55 g aluminum tristearate and 2045.5 g Isopar®-L were used. The initial dispersion was done at 10% solids and particle size reduction was done in 8 passes at 7.5% solids. For the particle size reduction, the Microfluidizer® was run at low air pressure: 13 psi external air supply which produced 1000 psi ($6.89\times10^6$ kg/m.sec.$^2$) internal liquid pressure and approximately 0.05 gallon (0.19 liter)/minute flow rate. Average particle size measured on a Malvern instrument was 14.3 μm. Results are found in Table 1 below.

EXAMPLE 7

Toner was prepared as described in Example 1 with the following exceptions: 150 g resin, 11.42 g Heucophthal blue G XBT-583D (Heubach, Inc.). 0.12 g Dalamar® Yellow YT-858D (Heubach, Inc.), 3.30 g aluminum tristearate and 1483.6 % Isopar®-L were used. The Microfluidizer® was equipped with a half-area interaction chamber and backpressure module (D10-H20) and run at 20,000 psi ($13.78\times10^7$ kg/m.sec.$^2$). Four passes at 10% solids were run in the particle size reduction step. Average particle size measured with a Malvern 3600E Particle Sizer was 5.9 μm. Results are found in Table 1 below.

EXAMPLE 8

The following ingredients were placed in a Union Process 1-S Attritor® (Union Process Co., Akron, Ohio), along with 0.1875 inch (4.76 mm) diameter carbon steel balls:

| Ingredients | Amount (g) |
|---|---|
| Copolymer of ethylene (89%) and methacrylic acid (11%): melt index at 190° C. is 100, acid number is 66 | 146.0 |
| Magenta Pigment R6713 (Mobay) | 10.0 |
| Magenta Pigment R6700 (Mobay) | 40.0 |
| Aluminum Tristearate #132, Witco Chemical Corporation, New York, NY | 4.0 |
| Isopar®-L (see Control 1) | 1800.0 |

The contents were heated to 110° C.+/−10° C. and milled at 220 rpm for 2.25 hours. The Attritor® was then cooled to 60° C.+/−5° C. and the mixture was separated from the carbon steel media. The mixture was passed twice through the Microfluidizer® as described in Example 1.

The toner concentrate was diluted to 2% solids by the addition of Isopar®-L. Two kg of toner were charged by the addition of 40 g of a 10% solution of Basic Barium Petronate® (Witco Chemical Corp., Sonneborn Division, New York, N.Y.) in Isopar®-L. An equilibration of 24 hours was allowed. Average particle size measured with Malvern 3600E Particle Sizer was 5.7 μm.

Performance of the toner was evaluated on a Savin 870 with Plainwell offset enamel number 3 60 1 b text paper (Plainwell Paper Co . Plainwell, Mich.). Results are shown in Table 1 below.

EXAMPLE 9

Toner was prepared as described in Example 1 using 100 g resin, 11.36 g Dalamar® Yellow YT-858D (Heubach), 2.27 g aluminum tristearate and 1022.7 g Isopar®-L. The ingredients were melted as described in Example 1 and then allowed to cool to room temperature without stirring. The mixture at 10% solids was shredded in a blender and particle size reduction was done in 8 passes at 10% solids. Average particle size measured with a Malvern 3600E Particle Sizer was 8.2 μm and for the Horiba was 2.66 μm. Results are found in Table 1 below.

CONTROL 2

A control toner using the same ingredients as described in Example 8 was prepared using only the Attritor®. The 1-S Attritor® was heated at 110° C. for 2.25 hours. After cooling to 60° C. milling was continued at 330 rpm for 6 hours. The toner concentrate was separated from the carbon steel media and diluted to 2 percent solids by the addition of Isopar®-L. Two kg of toner were charged by the addition of 40 g of a 10% solution of Basic Barium Petronate® in Isopar®-L and the dispersion allowed to equilibrate for 24 hours. Average particle size measured with Malvern 3600E particle sizer was 8.2 μm.

Performance of this toner was also evaluated on the Savin 870 copier with Plainwell offset enamel paper as described in Control 1. Results are shown in Table 1 below.

TABLE 1

| EXAMPLE | PART. SIZE RED. TIME (HOURS: MIN) | RESOLUTION 1 p/mm | DENSITY | % TE | IMAGE QUALITY |
|---|---|---|---|---|---|
| Control 1 | 9:00 | 10 | 0.92 | 70 | very good |
| 1 | 0:20 | 10 | 1.13 | 96 | very good |
| 2 | 0:20 | 6 | 0.98 | 98 | good |
| 3 | 0:20 | 8 | — | 100 | very good |
| 4 | 0:20 | 9 | 0.91 | 90 | good |
| 5 | 1:40 | 13 | 0.37 | 100 | very good |
| 6 | 2:40 | 7 | 1.34 | 88 | satisfactory |
| 7 | 1:20 | 10 | 1.19 | 82 | good |
| 8 | 0:20 | 10 | 2.0 | 86 | very good |
| 9 | 1:40 | 8 | 0.99 | 89 | good |
| Control 2 | 6:00 | 9 | 1.5 | 81 | very good |

*N/A = not applicable

EXAMPLE 10

Toner was prepared as described in Example 1 using 200 g resin, 11.11 g Uhlich 8200 Black (Paul Uhlich and Co., Inc., Hastings-on-Hudson, N.Y.), no aluminum tristearate and 1000 g Isopar®-L. Particle size reduction was accomplished at 10% solids. Average particle size measured with the Malvern 3600E Particle Sizer was 5.1 μm. Toner was diluted to 2% solids and charged with manganese naphthenate (ICN Biomedicals Inc., Plainview, N.J.) (300 mg/g) toner solids. Image quality showed reverse toning characteristic of positively charge toners.

We claim:

1. A process for the preparation of toner particles for liquid electrostatic imaging comprising A. mixing a thermoplastic resin and a nonpolar liquid at a temperature sufficient to plasticize and liquify the resin and below that at which the nonpolar liquid boils and the resin decomposes;

B. cooling the mixture to form particles of the resin in the nonpolar liquid;

C. reducing the size of the resin particles to below about 30 μm by passing the mixture of resin particles and nonpolar liquid through at least a plurality of nozzles within a liquid jet interaction chamber at a liquid pressure of at least 1000 p.s.i.

2. A process according to claim 1 wherein the mixing in step A is conducted in a vessel by means of moving particulate media.

3. A process according to claim 2 wherein the particulate media are taken from the group consisting of stainless steel, carbon steel, ceramic, alumina, zirconium, silica, and sillimanite.

4. A process according to claim 3 wherein the particulate media are spherical having an average diameter of 0.04 to 0.5 inch.

5. A process according to claim 1 wherein the mixing in step A is conducted in a vessel by stirring.

6. A process according to claim 1 wherein the mixing in step A is conducted in a liquid jet interaction chamber at a liquid pressure of at least 1000 p.s.i.

7. A process according to claim 1 wherein the liquid jet interaction chamber comprises, in combination, (a) a plurality of submerged nozzles providing elongated orifices arranged to eject under pressure a plurality of thin sheets of the mixture of thermoplastic resin and nonpolar liquid, the nozzles being arranged to effect turbulent jet action of the sheets along a common liquid jet interaction front and the sheets being ejected by the nozzles into a low pressure zone filled with the liquid further creating turbulent jet interaction along a common boundary essentially defined and formed by the mixture in the low pressure zone and by the sheets ejected into the low pressure zone;

(b) jet interaction chamber-defining means arranged to provide the low pressure zone of the liquid system in which the turbulent jet interaction is effected;

(c) inlet channel means to deliver the mixture under pressure to the nozzles; and (d) means to withdraw the mixture of resin particles and nonpolar liquid in the form of a dispersion from the low pressure zone.

8. A process according to claim 6 wherein the liquid jet interaction chamber comprises, in combination, (a) a plurality of submerged nozzles providing elongated orifices arranged to eject under pressure a plurality of thin sheets of the mixture of thermoplastic resin and nonpolar liquid, the nozzles being arranged to effect turbulent jet action of the sheets along a common liquid jet interaction front and the sheets being ejected by the nozzles into a low pressure zone filled with the liquid further creating turbulent jet interaction along a common boundary essentially defined and formed by the mixture in the low pressure zone and by the sheets ejected into the low pressure zone;

(b) jet interaction chamber-defining means arranged to provide the low pressure zone of the liquid system in which the turbulent jet interaction is effected;

(c) inlet channel means to deliver the mixture under pressure to the nozzles; and (d) means to withdraw the mixture of resin particles and nonpolar liquid in the form of a dispersion from the low pressure zone.

9. A process according to claim 1 wherein the thermoplastic resin is a copolymer of ethylene and an $\alpha$-$\beta$-ethylenically unsaturated acid selected from the group consisting of acrylic acid and methacrylic acid.

10. A process according to claim 1 wherein the thermoplastic resin is polyethylene.

11. A process according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

12. A process according to claim 11 wherein the thermoplastic resin is a copolymer of ethylene (89%)/methacrylic acid (11%) having a melt index at 190° C. of 100.

13. A process according to claim 1 wherein the thermoplastic resin is polystyrene.

14. A process according to claim 1 wherein a colorant is present in step A in an amount up to 60% by weight based on the total weight of developer solids.

15. A process according to claim 14 wherein the colorant is a pigment.

16. A process according to claim 14 wherein the colorant is a dye.

17. A process according to claim 1 wherein a colorant is present which is a pigment comprising finely divided ferromagnetic material 18. A process according to claim 14 wherein the colorant is a metal powder.

19. A process according to claim 1 wherein a fine particle size oxide is present.

20. A process according to claim 19 wherein the oxide is silica.

21. A process according to claim 1 wherein after step C a charge director in an amount of 1 to 1000 mg/g solids is added to impart an electrostatic charge of predetermined polarity to the resin particles.

22. A process according to claim 21 wherein the charge director is lecithin.

23. A process according to claim 21 wherein the charge director is Basic Barium Petronate.

24. A process acoording to claim 21 wherein the thermoplastic resin is a copolymer of ethylene and methacrylic acid (11%) having a melt index at 190° C. of 100.

25. A process according to claim 1 wherein the thermoplastic resin particles have dispersed therein a metallic soap.

26. A process according to claim 25 wherein the metallic soap is aluminum tristearate.

27. A process according to claim 25 wherein the metallic soap is present in 0.01 to 60% by weight based on the total weight of solids.

28. A process according to claim 1 wherein subsequent to step C diluting the mixture with additional nonpolar liquid.

29. A process according to claim 28 wherein the thermoplastic resin is a copolymer of ethylene (89%) and methacrylic acid (11%) having a melt index at 190° C. of 100.

30. A process according to claim 28 wherein the dilution is conducted to reduce the concentration of toner particles to between 0.1 to 3.0 percent by weight with respect to the nonpolar liquid.

31. A process according to claim 1 wherein the toner particles have an average particle size of less than 15 μm.

32. A process according to claim 1 wherein an additional compound is present which is an adjuvant taken from the group consisting of polyhydroxy compound, aminoalcohol, polybutylene succinimide and an aromatic hydrocarbon.

33. A process according to claim 32 wherein the adjuvant is a polyhydroxy compound.

34. A process according to claim 32 wherein the adjuvant is an aminoalcohol.

35. A process according to claim 32 wherein the adjuvant is polybutylene succinimide.

36. A process according to claim 32 wherein the adjuvant is an aromatic hydrocarbon.

* * * * *